United States Patent [19]

Toland

[11] 3,935,352

[45] Jan. 27, 1976

[54] SUPPORTED TURF OR CARPET-LIKE MATERIAL

[75] Inventor: William G. Toland, San Rafael, Calif.

[73] Assignee: Chevron Research Company, San Francisco, Calif.

[22] Filed: May 29, 1974

[21] Appl. No.: 474,456

[52] U.S. Cl. ..... 428/95; 156/325

[51] Int. Cl.[2] ..... D03D 27/00; D04H 11/00

[58] Field of Search ..... 161/21, 62–67; 57/140; 423/567; 428/95, 17; 156/325

[56] References Cited

UNITED STATES PATENTS 3,332,828 7/1967 Faria ..... 161/21

*Primary Examiner*—Marion E. McCamish

*Attorney, Agent, or Firm*—G. F. Magdeburger; John Stoner, Jr.; T. G. DeJonghe

[57] ABSTRACT

A method for obtaining a supported turf or carpet-like structure which comprises placing a layer of molten plasticized sulfur on a surface and then placing synthetic turf or carpet-like material, having its own backing, on the layer of plasticized sulfur.

6 Claims, 2 Drawing Figures

SUPPORTED TURF OR CARPET-LIKE MATERIAL

RELATED APPLICATIONS

The disclosure of my commonly assigned application, titled "Turf", Ser. No. 474,457, filed May 29, 1974, is related hereto and is incorporated herein by reference.

BACKGROUND OF THE INVENTION

The present invention relates to preparation of a supported turf or carpet-like structure particularly wherein the supporting means is plasticized sulfur.

U.S. Pat. No. 2,515,847 discloses a supported carpet-like surface. The turf or carpet-like surface of U.S. Pat. No. 2,515,847 is suitable for use as a putting green for golf and includes a top layer of rug material having a nap, and wherein the rug material is supported on center layers of sponge rubber-like material. The supported rug material is placed upon the earth.

It is also, of course, known to place carpet-like material on concrete and wooden surfaces.

Artificial turf materials have been placed on football fields and the like. Usually the artificial turf includes fibers contained in or woven into a backing and with a pad attached to the backing. The thus composed artificial turf material is usually directly placed on the earth or other surface as a unitary product. For example, U.S. Pat. No. 3,332,828 discloses an artificial turf in FIG. 2 including fibers in a backing and with the turf also being attached to a pad. In FIG. 5 of U.S. Pat. No. 3,332,828 the turf is shown with the backing but without the pad.

U.S. Pat. No. 3,422,615 also discloses a synthetic turf-like material which is referred to as a "pile fabric." Fibers which are indicated as being suitable for making the yarns used to make the pile fabric of U.S. Pat. No. 3,422,615 are said to include olefins, particularly polypropylene, and also other materials such as nylon, vinyl-vinylidene chloride, polyvinyl chloride, polyethylene, polyester, polyacrylonitrile, cellulose acetate, cellulose triacetate, rayon and glass in filamentary form.

Plasticized sulfur has been disclosed in various references, for example by J. I. Jin in "Chemistry of Plasticized Sulfur," Petroleum Division, A.C.S. Symposium, Vol. 19, No. 2, March 1974, pp. 234–241 and by C. Kinney Hancock in "Plasticized Sulfur Compositions for Traffic Marking," Industrial and Engineering Chemistry, Vol. 46, No. 11, November 1954, pp. 2431–2435. Exemplary patents disclosing plasticized sulfur include U.S. Pat. No. 3,316,115 "Marking Composition"; U.S. Pat. No. 3,434,852 "Plasticized Sulfur Compositions"; U.S. Pat. No. 3,447,941 "Sprayable Sulfur Road Marking Compositions"; U.S. Pat. No. 3,459,717 "Sulfur Based Plastic Composition"; U.S. Pat. No. 3,560,451 "Plastic and Nonflammable Sulfur Composition"; U.S. Pat. No. 3,453,125 "Plasticized Sulfur Compositions"; U.S. Pat. No. 3,674,525 "Plasticized Sulfur Compositions"; and U.S. Pat. No. 3,676,166 "Plasticized Sulfur Compositions". Also Ser. No. 286,627, which application has been offered for license by the U.S. Bureau of Mines, in the Official Gazette, Apr. 24, 1973, Vol. 909, p. 1179 discloses plasticized sulfur compositions.

SUMMARY OF THE INVENTION

In accordance with the present invention a method is provided for obtaining a supported turf or carpet-like structure which comprises placing a layer of molten plasticized sulfur on a surface and then placing synthetic turf or carpet-like material, having its own backing, on the layer of plasticized sulfur.

In accordance with a preferred embodiment of the present invention the plasticized sulfur layer is allowed to cool sufficiently to solidify before the synthetic turf or carpet-like material is placed on the plasticized sulfur layer.

Among other factors the present invention is based on my finding that the plasticized sulfur and artificial turf or carpet-like material with backing are very effective when used together, particularly as an outdoor surface, and in fact have a synergistic effect when used together. When using plasticized sulfur by itself there is often a tensile and flex strength problem and the plasticized sulfur often breaks or chips to some extent under stress of foot traffic. On the other hand when just using artificial turf or a lightweight layer of carpeting material on a soil, even soil which has been treated for example by aluminum hydroxychloride to help consolidate the soil, the carpet is susceptible to being punched through by high heels or similar objects. However, using the artificial turf or lightweight carpeting on top of a layer of plasticized sulfur results in a surface that is not easily punched through and furthermore the underlying plasticized sulfur is not easily broken up. Thus disadvantages of each by itself are overcome by use of the two components together.

The artificial turf or a carpeting can be used with or without a pad but the turf or carpet-like material should have its own backing or ribbing or the like holding together the fibers and/or yarns which make up the carpeting or turf.

Another advantage of the present invention is that the surface provided can be prepared relatively easily and quickly. Plasticized sulfur can be prepared in large quantities and can be easily molded to various contours by application in a molten state. On the other hand, when working with asphalt to obtain a support for a turf surface there is difficulty in placing the asphalt into irregular spaces and it is also more difficult to get good adhesion to asphalt than can be accomplished with the components of the present invention.

Also, the curing or solidifying time is quite short for the plasticized sulfur compared to curing time of concrete. Furthermore, I have found the plasticized sulfur, in combination with the turf, is relatively lightweight for a given amount of strength or thickness compared to the combination of synthetic turf on concrete.

Plasticized sulfur compositions contemplated by the present invention preferably contain principally sulfur. Preferably the plasticized sulfur contains more than 50 weight percent sulfur and more preferably about 70–90 weight percent sulfur or more.

Also the plasticized sulfur compositions comtemplated by the present invention are ones which will solidify in a relatively short time under ambient temperature conditions, for example solidify in less than about 30 minutes and usually less than about 5 minutes.

In addition to a method of preparation, the present invention also provides a novel product, namely the product produced by the methods as herein described and thus comprising a synthetic turf or carpet-like material having its own backing and being supported by a layer of plasticized sulfur.

The product of the present invention is particularly useful as an outdoor surface because of the ease of working with the molten plasticized sulfur and covering turf-like materials; also because the turf cannot be ripped up or rolled up and taken away as can be done with a rubber or latex pad of the like. In accordance with a preferred embodiment of the present invention the artificial turf is placed on the plasticized sulfur when the plasticized sulfur is still molten so that the turf or carpet-like material will become substantially integral or rigidly attached to the plasticized sulfur. Alternatively the turf or carpet-like structure having its own backing can be glued to the plasticized sulfur or it can be attached to the plasticized sulfur using conventional methods such as tacking it to the plasticized sulfur.

Preferably the turf or carpet-like structure which is placed on and/or attached to the plasticized sulfur contains a backing but it need not necessarily contain, in addition to the backing, pad or sponge-like material further attached to the turf or carpet-like structure.

Plasticized sulfur as the term is used herein usually has a lower melting point and a higher viscosity than elemental sulfur. Furthermore, plasticized sulfur requires a longer time to crystallize; i.e., the rate of crystallization of plasticized sulfur is slower than that of elemental sulfur. One useful way to measure the rate of crystallization is as follows: the test material (0.040 g) is melted on a microscope slide at 130°C. and is then covered with a square microscope slide cover slip. The slide is transferred to a hot-plate and is kept at a temperature of 78°±2°C., as measured on the glass slide using a surface pyrometer. One corner of the melt is seeded with a crystal of test material. The time required for complete crystallization is measured. Plasticized sulfur, then, is sulfur containing an additive which increases the crystallization time within experimental error, i.e., the average crystallization time of the plasticized sulfur is greater than the average crystallization time of the elemental sulfur feedstock. For the present application, plasticizers are those substances which, when added to molten, elemental sulfur, cause an increase in crystallization time in reference to the elemental sulfur itself. In one set of experiments, elemental sulfur required 0.44 minute to crystallize under the above conditions, whereas sulfur containing 3.8% of a phenol-sulfur adduct (as described in commonly assigned patent application Ser. No. 344,694 entitled "Cellular Products Produced by Foaming and Cross-Linking Aromatic polysulfides," filed Mar. 26, 1973) required 2.9 minutes. Sulfur containing 6.6% and 9.9% of the same phenol-sulfur adduct required 5.7 and 22 minutes, respectively.

Inorganic plasticizers include iron, arsenic and phosphorus sulfides, but the particularly preferred plasticizers are organic compounds which can react with sulfur to give sulfur-containing materials, such as styrene, alphamethylstyrene, dicyclopentadiene, vinyl cyclohexene, the aromatic compound-sulfur adducts of said Ser. No. 344,694 as well as the aromatic compounds used to produce these adducts, aromatic or aliphatic liquid polysulfides (e.g., those sold under the trade name of Thiokol LP-3 or LP-321, and the viscosity control agents described in U.S. Pat. Nos. 3,674,525, 3,453,125 and 3,676,166. The preferred aromatic plasticizing compounds are styrene and the phenol-sulfur adduct of said Ser. No. 344,694. The preferred aliphatic compound is dicyclopentadiene.

One preferred plasticized sulfur substance contains dicyclopentadiene, sulfur, glass fiber and talc.

The elemental sulfur may be either crystalline or amorphous and may contain small amounts of impurities such as those normally found in commercial grades of sulfur. Optimum proportions of sulfur, as well as of the other components of the composition may vary considerably. However, proportions of sulfur of about 73 to 97%, by weight, are generally satisfactory.

Dicyclopentadiene is readily available commercially, generally at a purity of about 96% or greater. Preferably it is used in the above preferred plasticized sulfur composition in an amount of about 1 to 7% by weight.

The glass fiber of the preferred plasticized sulfur composition is preferably employed in the form of milled fibers, with the fibers generally ranging from about 1/32 to ¼ inch in length, preferably with an average length of about 1/16. These fibers, which generally consist of high-silica glass, are readily available commercially, often coated with a starch binder. The type of glass is, however, not critical, as long as it provides the resulting composition with adequate shear strength, preferably a shear strength of about 400 to 800 psi. The glass fiber preferably constitutes about 1 to 5% by weight of the composition of the invention.

The talc used in the preferred dicyclopentadiene-sulfur-glass fiber-talc composition preferably is a foliated type, or a compact variety such as steatite. Impure varieties such as soapstone can also be used. This ingredient is preferably used in an amount of about 1 to 15% by weight of the composition, and serves the dual function of providing thixotropy to the mixture and of dispersing the glass fiber throughout the composition, thereby preventing agglomeration of the fibers.

The preferred composition is used as a fluid mixture of the ingredients, with the sulfur and dicyclopentadiene in molten form and the glass fiber and talc distributed throughout the molten material. Thus the composition is prepared by homogeneous mixing of the ingredients at elevated temperature sufficient to maintain the sulfur and dicyclopentadiene in a molten state. A temperature of about 240° to 320°F. is satisfactory, with about 275° to 320°F. being preferred. Any conventional vessel or reactor capable of providing the required temperature and mixing means may be used for preparation of the composition.

DRAWING

Figure 1:
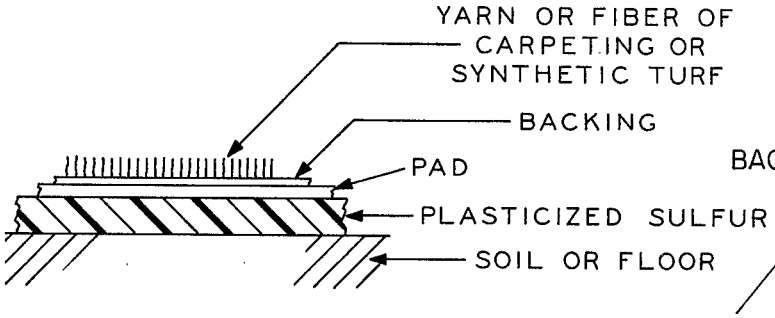
FIG. 1 is a schematic illustration of synthetic turf or carpet-like material supported on plasticized sulfur using a pad between the yarns or fibers of the turf and the plasticized sulfur.
Figure 2:
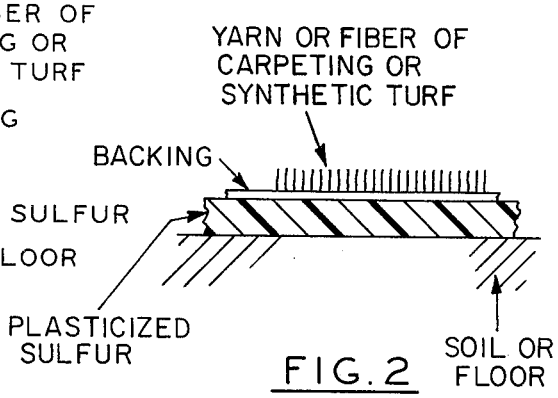
FIG. 2 is a schematic illustration wherein no pad is used and the synthetic turf with backing rests on or is attached directly to the plasticized sulfur.

What is claimed is:

1. A method for obtaining a supported turf or carpet-like structure which comprises placing a layer of molten plasticized sulfur on a surface and then placing, on the layer of plasticized sulfur, synthetic turf or carpet-like material having its own backing, and wherein the synthetic turf or carpet-like material is placed backing side down on the layer of plasticized sulfur.

2. A method in accordance with claim 1 wherein the plasticized sulfur layer is allowed to cool sufficiently to solidify before the synthetic turf or carpet-like material is placed on the plasticized sulfur layer.

3. A method in accordance with claim 1 wherein the sulfur is plasticized with dicyclopentadiene, aliphatic polysulfide, aromatic polysulfide or mixtures thereof.

4. A method in accordance with claim 1 wherein the synthetic turf or carpet-like material is placed on molten plasticized sulfur so that the turf or carpet-like material becomes rigidly attached to the plasticized sulfur when it solidifies.

5. A supported turf or carpet-like structure comprising a solidified layer of plasticized sulfur and synthetic turf or carpet-like material placed thereon and wherein the synthetic turf or carpet-like material has its own backing.

6. A supported turf or carpet-like material in accordance with claim 5 wherein the backing of the turf or carpet-like material is bonded to the plasticized sulfur by glue or an adhesive.

* * * * *